US005656133A

United States Patent [19]

Savia

[11] Patent Number: 5,656,133

[45] Date of Patent: Aug. 12, 1997

[54] HYBRID FORMER FOR A PAPER MACHINE

[75] Inventor: Risto Savia, Kotka, Finland

[73] Assignee: Valmet Corporation, Helsinki, Finland

[21] Appl. No.: 465,762

[22] Filed: Jun. 6, 1995

[30] Foreign Application Priority Data

Jun. 17, 1994 [FI] Finland ..... 942900

[51] Int. Cl.[6] ..... D21F 1/00; D21F 11/00

[52] U.S. Cl. ..... 162/203; 162/300; 162/301

[58] Field of Search ..... 162/203, 208, 162/300, 301, 348, 352

[56] References Cited

U.S. PATENT DOCUMENTS

| | | | |
|---|---|---|---|
| 2,881,670 | 4/1959 | Thomas | 92/39 |
| 2,881,671 | 6/1959 | Thomas | 162/301 |
| 4,417,950 | 11/1983 | Bubik et al. | 162/352 |
| 4,532,008 | 7/1985 | Creagan et al. | 162/203 |
| 4,917,766 | 4/1990 | Koivuranta et al. | 162/301 |
| 4,988,408 | 1/1991 | Evalahti | 162/301 |
| 5,185,064 | 2/1993 | Nyman | 162/301 |
| 5,215,628 | 6/1993 | Koivuranta et al. | 152/301 |
| 5,282,933 | 2/1994 | Bubik et al. | 162/301 |
| 5,395,484 | 3/1995 | Odell et al. | 162/203 |

FOREIGN PATENT DOCUMENTS

| | | |
|---|---|---|
| 0287276 | 10/1988 | European Pat. Off. . |
| 90572 | 3/1989 | Finland . |
| 885607 | 6/1990 | Finland . |
| 905447 | 5/1992 | Finland . |
| 924289 | 9/1992 | Finland . |
| 88057 | 12/1992 | Finland . |
| 93128 | 1/1993 | Finland . |
| 930927 | 3/1993 | Finland . |
| 932265 | 5/1993 | Finland . |
| 932793 | 6/1993 | Finland . |
| 91092 | 1/1994 | Finland . |
| 91173 | 2/1994 | Finland . |
| 931951 | 10/1994 | Finland . |
| 934999 | 9/1995 | Finland . |
| 2106945 | 4/1983 | United Kingdom . |
| 212863 | 2/1984 | United Kingdom . |
| 9302250 | 2/1993 | WIPO . |

*Primary Examiner*—Karen M. Hastings

*Attorney, Agent, or Firm*—Steinberg, Raskin & Davidson, P.C.

[57] ABSTRACT

A hybrid former in a paper machine including a lower-wire loop in which there is an initial single-wire portion of a forming zone. In this initial portion, there are draining elements inside the lower-wire loop and thereafter wire-guide and draining elements. The former includes an upper-wire unit in which an upper wire is guided by guide rolls and by a breast roll onto a pulp layer formed on the single-wire portion of the lower wire. In a subsequent twin-wire portion following the single-wire portion, there is a draining and forming unit which includes at least one pressure-loaded press unit and at least one draining-chamber and support unit, which units are arranged inside opposite wire loops. In the units, there are sets of ribs which are pressure-loaded against each other. The breast roll is provided with an open face and is arranged in such a position that the area of the breast roll and upper wire that reach contact with the pulp web is pressed slightly into the upper face of the pulp web without curving the lower wire to a substantial extent.

8 Claims, 2 Drawing Sheets

HYBRID FORMER FOR A PAPER MACHINE

BACKGROUND OF THE INVENTION

The present invention relates to a hybrid former and specifically to an inlet into a twin-wire zone in a hybrid former for a paper machine. The former comprises a lower-wire loop in which there is a single-wire initial portion of the forming zone and draining elements arranged inside the lower-wire loop. After the draining elements, inside an upper-wire loop and the lower-wire loop, which together form the twin-wire zone, wire-guide, forming and draining elements are arranged. The former includes an upper-wire unit in which there is the upper wire which is guided by rolls and which is guided by the breast roll onto a pulp layer formed on the single-wire initial portion of the lower wire. In the former, in the twin-wire zone thereof, there is a dewatering and forming unit or units. The present invention also relates to a method in a hybrid former of a paper machine.

A gap former is mostly better than a hybrid former both in view of the quality of the paper and in view of the runnability, but for many paper mills, a gap former, which also requires modernization of the existing headbox, is an excessively costly construction. In a number of cases, a more advantageous construction would be an upper-wire unit placed close to the headbox, by means of which construction at least a part of the favorable properties of a gap former are obtained. In modernizations of paper machines, this would permit the use of the existing fourdrinier headbox.

It is a general object of the present invention to develop a novel inlet solution for the twin-wire zone of a hybrid former in particular for modernizations of existing fourdrinier wire parts and formers marketed by the assignee under the trade mark SYM FORMER™ in view of improving the paper quality, widening the range of use, and/or increasing the running speeds of paper machines. It should, however, be emphasized that the former in accordance with the present invention is also suitable for use in completely new formers.

In web formers of paper machines, a number of different forming members are used. The primary function of these members is to produce compression pressure and pressure pulsation in the fiber layer that is being formed. By means of the pressure and pulsation, the draining of water out of the web that is being formed is promoted while the formation of the web is improved. The forming members include various forming shoes which are usually provided with a curved ribbed deck and over which the forming wires placed one above the other and the web placed between them are curved. In the area of these forming shoes, water is drained through the wire placed at the side of the outside curve by the effect of its tensioning pressure, and this draining is aided further by a field of centrifugal force. Draining of water also takes place through the wire placed at the side of the inside curve, which draining is typically intensified by means of a vacuum present in the chamber of the forming shoe. The ribbed deck of the forming shoe produces pressure pulsation which both promotes the dewatering and improves the formation of the web.

Also, in the prior art, so-called MB-units are known, through which two opposite wires run. Inside one of the wire loops in the prior art MB-units, there is loading equipment, and inside the other, opposite wire loop, dewatering equipment is arranged which is provided with a set of guide and dewatering ribs in opposed relationship to the loading equipment. As known in the prior art, the MB-unit is usually placed on a fourdrinier portion so that the MB-unit is preceded by a single-wire portion of considerable length in which a substantial proportion of draining takes place before the web runs through the MB-unit. With respect to the details of construction of the prior art MB-units, reference is made, by way of example, to the assignee's Finnish Patent Application Nos. 884109 and 885607 (corresponding to U.S. Pat. Nos. 5,185,004 and 4,988,408, respectively, the specifications of which are hereby incorporated by reference herein).

In the prior art, a number of different hybrid and gap formers are known which are provided with an MB-unit or units as referred to above. With respect to these formers, reference is made to the following Finnish Patent Applications: 884109, 885608, 904489, 905447, 920228, 920863, 924289, 930927, 931950, 931951, 931952, 932265, 932793 and 934999. FI 885608, FI 932265 and FI 932793 correspond to U.S. patent application Ser. Nos. 07/442,013, 08/246,176 and 08/262,138, respectively, the specifications of which are hereby incorporated by reference herein. FI 904489 and FI 920228 correspond to U.S. Pat. Nos. 5,215,628 and 5,395,484, respectively, the specifications of which are hereby incorporated by reference herein.

The inlet of the twin-wire forming zone has proved a critical point in general and in particular when MB-forming units are used. It has been noticed that the initial part of the MB-unit has a substantial effect, e.g., on the retention and on the porosity of the paper. Problems are produced in particular because, when the upper wire enters into contact with the top face of the pulp web that is being formed, the fiber structure "freezes", in which case any unevenness present in the upper wire or in the top face of the pulp layer is seen as flaws in the finished paper. The unevenness is more likely to occur when the upper wire is brought into contact with the top face of the pulp layer in a curved area while the upper wire runs unsupported at that location.

With respect to the prior art closely related to the present invention, reference is made to the assignee's Finnish Patent Application No. 934999 (filed Nov. 12, 1993) which describes a former in which at an initial portion of the twin-wire forming zone, there is a revolving alignment and forming roll arranged inside the lower-wire loop. The alignment and forming roll is in tangential contact with the lower wire or curves the twin-wire zone at a small angle a, which angle is selected in the range of about 0° to about 5°. The alignment and forming roll is substantially immediately followed by the draining and forming unit which comprises sets of ribs and in whose area, water is drained primarily through the upper wire while aided by the negative pressures in the draining chamber or chambers in the draining and forming unit.

In the former described in FI 934999 and in other, corresponding formers, it is a drawback that the forming roll placed at the beginning of the twin-wire zone inside one of the wire loops produces such a high dewatering pressure that, in particular with thicker paper grades, the structure of the web is broken, i.e. the web is "crushed". An obvious solution for this problem is to increase the diameter of the forming roll to about 2 meters which, however, makes the construction quite costly and spacious. In view of the web formation and the symmetry of draining, it would be of great importance that, in hybrid formers, the twin-wire forming zone can be started in an area in which the dry solids content of the web is from about 0.7% to about 1.7% and in which the face of the fiber layer that is placed against the lower wire has already been couched to a suitable extent, but the top face is still almost at the headbox consistency. However, with earlier former constructions, it has for the most part been possible to start the twin-wire zone only at a location at which the dry solids content is about 2.5% and the thickness of the web layer is maximally from about 5 mm to about 6 mm. It has not been possible to achieve even a consistency as low as this (2.5%) with thicker paper grades.

Shifting the upper-wire unit quite close to the headbox involves prior art in itself known. These prior art constructions involve certain problems and drawbacks, for which problems the present invention offers novel solutions. When a covered former roll is used at the inlet of a hybrid former, a sufficient support and a stable run are obtained for the wires but, at the same time, the inlet consistency of the pulp web is confined to a range that is not optimal in view of the quality of the paper. On the other hand, the use of dewatering ribs and of the pulsating draining pressure produced by them in the inlet area is problematic in gap formers, as is well known, for example, in view of formation of streaks and in view of retention.

With respect to the additional prior art related to the present invention, reference is made to the Finnish Patent Application No. 913480 assigned to Valmet Tampella Oy, in which a gap accomplished by means of an open roll and having no covering angle is used together with a curved ribbed deck following after the gap.

OBJECTS AND SUMMARY OF THE INVENTION

Accordingly, it is an object of the present invention to further develop the hybrid former described in Finnish Patent Application No. 934999 and of other, corresponding formers, in particular so that the former is also suitable for use with thicker paper grades and/or with higher web speeds and so that the objectives mentioned above are achieved and the drawbacks are avoided.

It is a further object of the present invention to provide a hybrid former in which an increased amount of water can be removed upward, i.e., through the upper wire, so that a more symmetric sheet is provided.

In view of achieving the objects stated above and others, in the invention, there is a breast roll provided with an open face at the inlet into the twin-wire zone. The breast roll is arranged in such a position that the area of the breast roll that reaches contact with the pulp web is pressed slightly into the upper face of the pulp web without curving the lower wire to a substantial extent.

According to the invention, when a breast roll of quite an open face is used at the inlet of the twin-wire zone, which breast roll is pressed slightly into the top face of the pulp layer, dewatering is produced through the upper wire, and as a result of this, a thin fiber layer is couched on the upper wire. The fiber layer that has been couched in the area of the open breast roll guarantees good retention on the following dewatering ribs. Also, the open breast roll produces a shear force of the desired magnitude in the pulp layer, which force serves to disintegrate any flocks that have been formed in the pulp layer and thus improve the base formation of the web.

Owing to the small coverage of the open breast roll arranged in accordance with the invention, a paper can be produced in which the ratio of the tensile strengths in the machine direction and in the cross direction is lower than in the prior art and typically in the range of about 1.5 to about 2, which is particularly advantageous, for example, in the case of fine papers.

The inlet into the twin-wire zone in accordance with the invention can be made stable, and in its area no detrimental sharply pulsating dewatering pressure is applied to the pulp web.

With a former in accordance with the invention, it is also possible to run paper grades thicker than in the prior art, typically of a grammage higher than about 170 g/m$^2$, whose production has not been possible earlier with corresponding hybrid formers while, at the same time, retaining a good base of the paper.

The open breast roll in accordance with the invention is typically placed in a position in which it presses a depression of about 1 mm to about 5 mm into the top face of the pulp web. The breast roll that is used is quite an open breast roll, so that the proportion of open face is from about 50% to about 80% of the area of active cylinder mantle of the breast roll.

An open breast roll in accordance with the invention is preferably arranged in a position in which the consistency of the fiber layer ($k_o$) is in a range from about 0.7% to about 1.7%.

In the method for forming a web in a hybrid former in a paper machine in accordance with the invention, a lower wire is guided in a loop and forms an initial single-wire portion of a forming zone, draining elements are arranged in the lower-wire loop in the single-wire portion, an upper wire is guided in a loop by guide rolls, a breast roll is arranged in the upper-wire loop for guiding the upper wire into contact with the web being carried on the lower wire to form a subsequent twin-wire portion of the forming zone following the single-wire portion, and wire-guide, forming and draining elements are arranged in the lower-wire loop and in the upper-wire loop. The breast roll is adjusted to a position in which it presses into an upper face of the web without curving or deflecting the lower wire to a substantial extent. Preferably, the breast roll and upper wire running thereover are pressed into the upper face of the web to a depth from about 1 mm to about 5 mm. Also, the breast roll is positionable in a position in which the fiber consistency of the web is from about 0.7% to about 1.7%. The diameter of the breast roll is selected to be between about 500 mm and about 1200 mm based on the width of the upper wire.

In the following, the invention will be described in detail with reference to some exemplifying embodiments of the invention illustrated in the figures in the accompanying drawing. However, the invention is by no means strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE DRAWINGS

Figure 1:
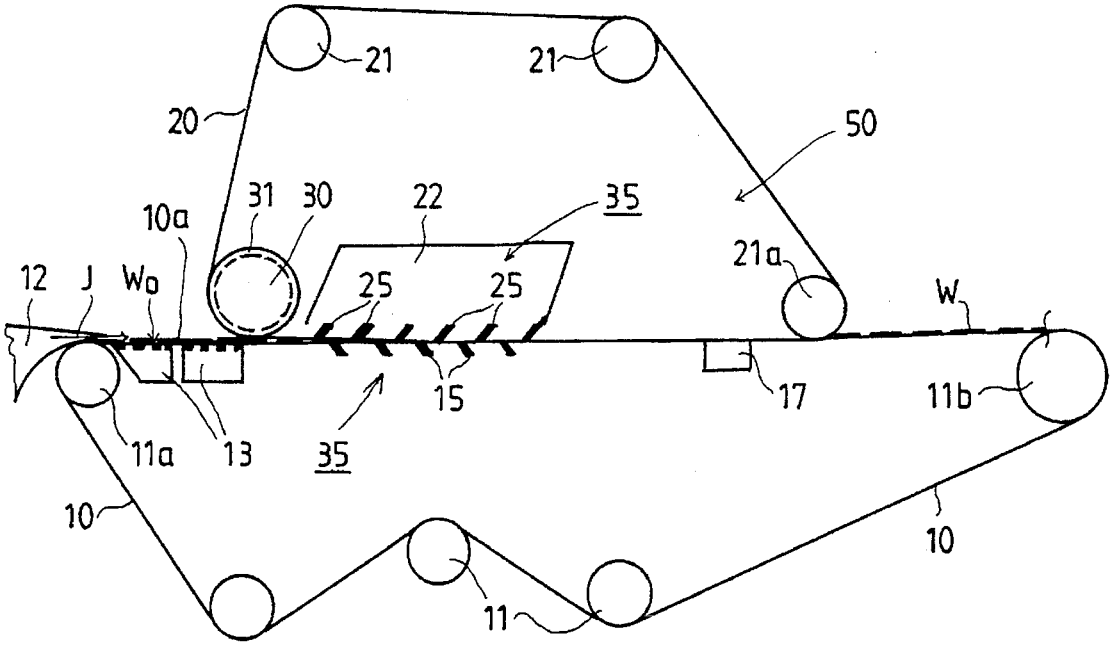
FIG. 1 is a schematic side view of a first environment of application of the invention.
Figure 2:
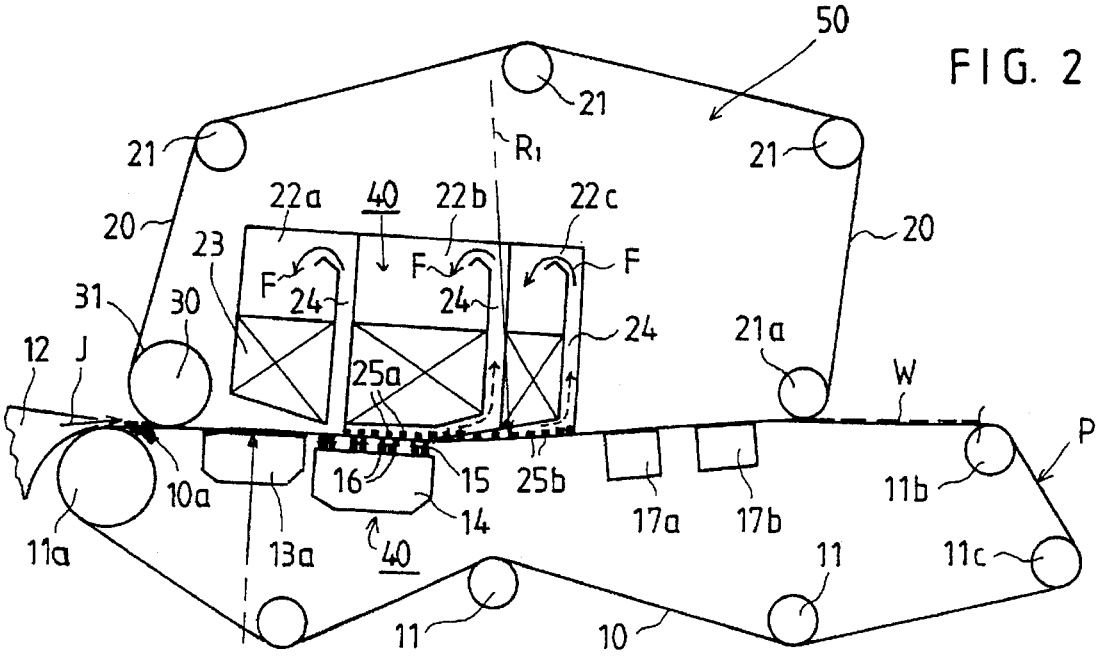
FIG. 2 is an illustration similar to FIG. 1 of a second environment of application of the invention.

Referring to the drawings wherein the same reference numerals refer to the same or similar elements, FIGS. 1 and 2 illustrate hybrid formers, which are also suitable for modernizations of existing fourdrinier wire parts or SYM FORMER™. In such a case, an existing fourdrinier wire part has been modernized by adding a new upper-wire unit 50 constructed on support of its frame part. The former shown in FIGS. 1 and 2 may, of course, also be a new construction.

In the unit 50, a lower wire 10 is guided by rolls 11, 11*b*, 11*c*, and through an area after a slice 12 of a headbox whereby a pulp suspension jet J is discharged from the slice to the area of a breast roll 11*a* to an inlet end of a single-wire initial portion 10*a* of the web forming zone. In this initial portion 10*a*, there are dewatering elements 13 in themselves known, such as foils and suction foils.

The subsequent twin-wire zone in the forming zone, which is defined between the lower wire 10 and an upper wire 20, starts in the area of a breast roll 30 having an open-face and being situated in a loop of the upper wire 20. After the breast roll 30, in the twin-wire zone, sets of ribs 15,25 are arranged, as shown in FIG. 1, which sets of ribs apply a pulsating dewatering pressure to the pulp web W. In FIG. 1, the sets of ribs 15,25 are included as a part of a dewatering and forming unit 35. A drain box 22 is placed around the upper set of ribs 25 and may communicate with a source of vacuum. Inside the lower-wire loop 10, the unit 35 is followed by upper and/or lower suction boxes 17 after which the upper wire 20, guided over a guide roll 21*a*, is separated from the web W formed in the forming zone, which runs further on the lower wire 10 to the wire suction roll 11*b*, in or after whose area the web W is transferred onto the pick-up fabric (not shown).

In the hybrid former shown in FIG. 2, after the open breast roll 30, there is a curved shoe with a ribbed deck arranged inside the lower-wire loop. The shoe may be provided with one or more suction chambers. After the ribbed shoe, inside the upper-wire loop, there are drain chambers 22*a*,22*b* and 22*c* of the MB-unit 40, in which chambers there are drain ducts 24. Through the drain ducts 24, the water that is drained through the loop of the upper wire 20 is passed in the direction of the arrows F into drain ducts 23, which are connected to suction legs (not shown). The drain chambers 22*a*,22*b* and 22*c* communicate with vacuum sources (not shown). Below the initial part of the upper set of ribs, inside the lower-wire loop, there is a loading unit 14. In the loading unit 14, there are loading ribs 15 placed facing the gaps between ribs 25*a* of the MB-unit 40, and before the ribs, which are pressed by means of the pressures of a medium passed into hoses 16 below the ribs 15 against the stationary ribs 25*a* so as to apply a dewatering pressure and shear forces to the pulp web W. As shown in FIG. 2, the opposite sets of ribs 15,25*a* are followed by a stationary set of support ribs 25*b*, which is placed below the third drain chamber 22*c* without opposite loading ribs. The last set of ribs 25*b* guides the twin-wire zone upwards with a curve radius $R_1$ from about 3 m to about 10 m. The surrounding of the sets of loading ribs 15 can also be connected with sources of vacuum.

In the final portion of the twin-wire zone, inside the lower-wire loop 10, there are suction boxes 17*a* and 17*b*. The upper wire 20 is separated from the paper web W at the location of the latter one of the suction boxes while guided by the guide roll 21*a*. The web W is separated from the lower wire at a pick-up point P between the rolls 11*b* and 11*c* and, while aided by the suction zone of the pick-up roll, is transferred onto the pick-up fabric which carries the web W to a press section (not shown).

Of the draining taking place in the twin-wire zone, for example, about 80% takes place through the upper wire 20 into the drain chambers 22*a*,22*b*,22*c* while intensified by a vacuum or vacuums.

The former constructions described above are primarily known from the prior art, and they are described here just as some typical and preferred exemplifying embodiments of some preferred environments of application of the invention that will be described in the following. The invention is, however, by no means confined to these environments.

Figure 3:
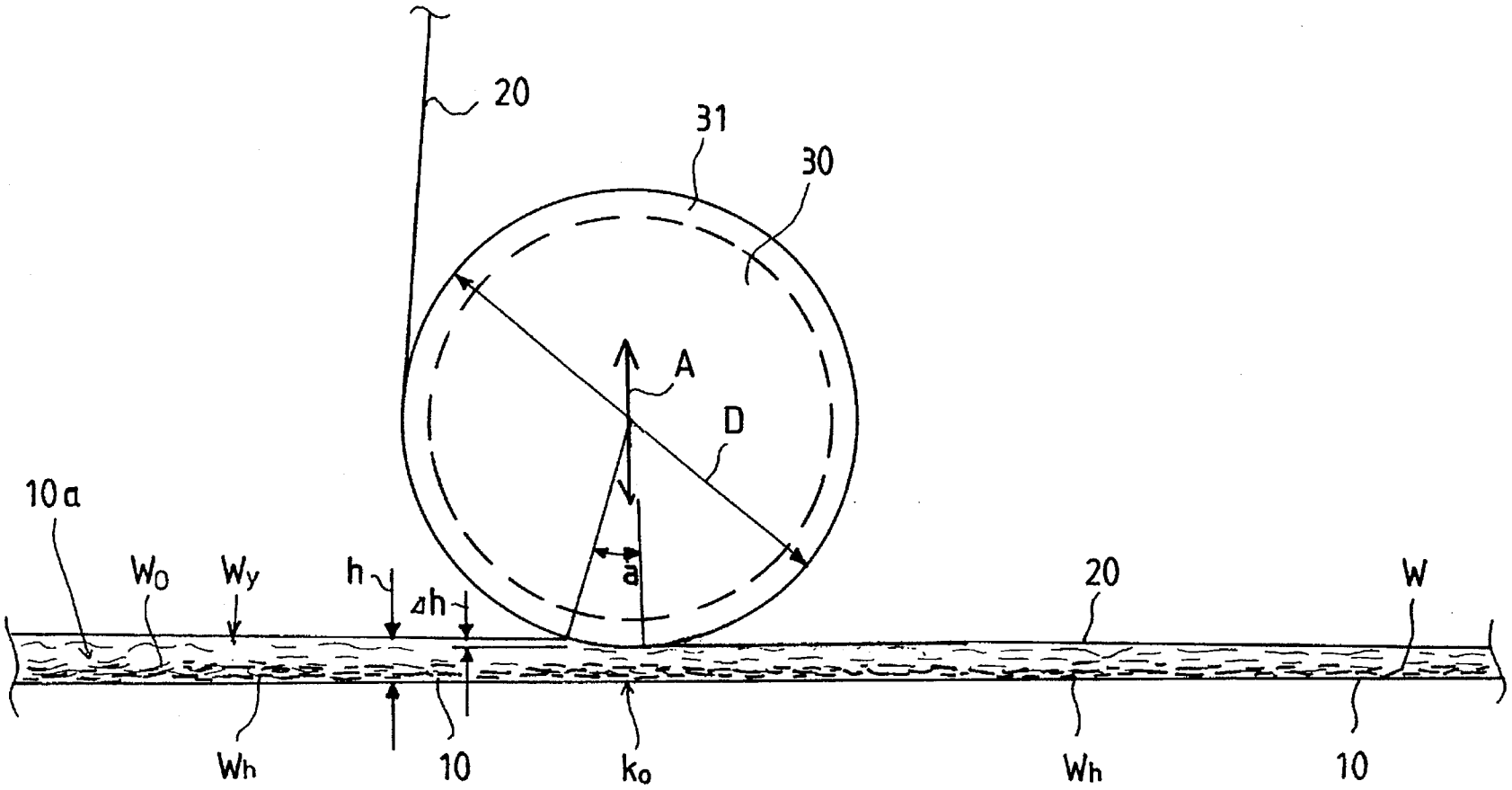
FIG. 3 is an enlarged vertical sectional view in the machine direction of an inlet into the twin-wire zone in accordance with the invention.

In the following, mainly with reference to FIG. 3, an exemplifying embodiment of the construction of the inlet into a twin-wire zone in accordance with the invention and the operation of such a construction will be described. In the single-wire initial portion 10*a* of the lower wire 10, by the inlet, the layer Wh of the pulp web W that is placed against the lower wire 10 has been couched to a certain extent. However, in the top face and layer Wy of the pulp web $W_0$, there is still stock approximately of the headbox consistency in the area of the breast roll 30, over which breast roll the upper wire 20 is guided onto the pulp web $W_0$. Thus, in accordance with the invention, the height position of the breast roll 30 is set and/or adjusted in the direction of arrow A, precisely in such a position that its lowest mantle portion is depressed into the pulp web $W_0$ slightly while, nevertheless, not curving the lower wire 10 substantially. In FIG. 3, the "depression" $\Delta h$ of the pulp web $W_0$ is typically from about 1 mm to about 5 mm. In this manner, the breast roll 30 couches a fiber layer against the upper wire, as a result of which an improved retention is obtained on the subsequent ribs 15,25 (FIG. 1) and 15,25*a*,25*b* (FIG. 2) in the hybrid former. Thus, the area a of the breast roll 30 press slightly the upper wire 20 into contact with the upper face of the web.

The breast roll 30 is moved in the direction of arrow A by roll adjusting means which is represented symbolically by the arrow.

As the breast roll 30, a breast roll is used that has a very open mantle 31, in which the proportion of the open face out of the entire active mantle face is typically from about 50% to about 80%. Preferably, an open-faced breast roll 30 that is covered with a wire sock is used. As the breast roll 30, it is also possible to use a suction roll provided with a mantle 31 with through perforations, whose suction zone is at least partly placed against the web. The diameter D of the breast roll 30 is typically from about 500 mm to about 1400 mm, depending on the width of the machine. At the inlet point defined by the breast roll 30, the average fiber consistency $k_0$ of the pulp web W is in the invention from about 0.7% to about 1.7%. Thus, the breast roll 30 in accordance with the invention may be positioned in an area of a fiber consistency lower than the inlet consistencies in other formers without a risk of breaking or crushing of the structure of the pulp layer in the web $W_0$. Owing to the positioning of the breast roll 30 in accordance with the invention, no excessively sudden dewatering pulse is produced in the area of the breast roll 30, so that the invention may also be applied to thicker grades than in the prior art (grammage>170 g/m$^2$), in which the thickness of the pulp web at the inlet (h) is typically from about 8 mm to about 25 mm.

The examples provided above are not meant to be exclusive. Many other variations of the present invention would be obvious to those skilled in the art, and are contemplated to be within the scope of the appended claims.

I claim:

1. A hybrid former in a paper machine, comprising a lower wire guided in a loop and forming an initial single-wire portion of a forming zone, draining elements arranged in said lower-wire loop in said single-wire portion, an upper wire guided in a loop by guide rolls, a breast roll arranged in said upper-wire loop for guiding said upper wire into contact with a web being carried on said lower wire to form a subsequent twin-wire portion of the forming zone following said single-wire portion, said breast roll being situated in a position in which the fiber consistency of the web is from about 0.7% to about 1.7%, said breast roll having an open, non-perforated mantle in which the proportion of opening in said mantle is from about 50% to about 80% of the total area of said mantle whereby water removed from the web through said upper wire is carried in connection with said open, non-perforated mantle, wire-guide, forming and draining elements arranged in said lower-wire loop and in said upper-wire loop, said forming and draining elements comprising at least one MB-unit arranged in said twin-wire zone, said at least one MB-unit including at least one drain box arranged in said upper-wire loop, at least one stationary set of support ribs arranged below said at least one drain box in said upper-wire loop, and a loading unit arranged in said lower-wire loop and including a set of ribs and loading means for loading said set of ribs with a medium, said set of ribs in said lower-wire loop being arranged in opposed relationship to said set of support ribs in said upper-wire loop, and web retention enhancing means arranged in advance of said at least one MB-unit for improving retention of fines/fillers in the web as the web passes through said at least one MB-unit, said web retention enhancing means comprising pressing means for moving said breast roll to press an area of said breast roll over which said upper wire runs into an upper face of the web without curving said lower wire to a substantial extent and such that a thin couched layer of the web is formed at said upper face, said couched layer of the web causing fines/fillers to be retained in the web as the web passes over said set of support ribs in said upper-wire loop of said at least MB-unit.

2. The hybrid former of claim 1, wherein said pressing means press said breast roll and said upper wire running thereover into the upper face of the web to a depth from about 1 mm to about 5 mm.

3. The hybrid former of claim 1, wherein said forming and draining elements further comprise a forming shoe having a curved ribbed deck arranged in said twin-wire zone, said ribbed shoe curving said twin-wire zone downward with a curve radius from about 3 m to about 10 m.

4. The hybrid former of claim 1, wherein said forming and draining elements further comprise at least one suction flatbox arranged in said lower-wire loop after said MB-unit, said upper wire being separated from the web in the area of said at least one suction flatbox and the web then being passed on support of said lower wire.

5. The hybrid former of claim 1, wherein said breast roll has a diameter between about 500 mm and about 1200 mm which is selected based on the width of said upper wire.

6. In a method for forming a web in a hybrid former in a paper machine, in which a lower wire is guided in a loop and forms an initial single-wire portion of a forming zone, draining elements are arranged in said lower-wire loop in said single-wire portion, an upper wire is guided in a loop by guide rolls, a breast roll is arranged in said upper-wire loop for guiding said upper wire into contact with a web being carried on said lower wire to form a subsequent twin-wire portion of the forming zone following said single-wire portion, and wire-guide, forming and draining elements arranged in said lower-wire loop and in said upper-wire loop, said forming and draining elements comprising at least one MB-unit arranged in said twin-wire zone, said at least one MB-unit including at least one drain box arranged in said upper-wire loop, at least one stationary set of support ribs arranged below said at least one drain box in said upper-wire loop, and a loading unit arranged in said lower-wire loop and including a set of ribs and loading means for loading said set of ribs with a medium, said set of ribs in said lower-wire loop being arranged in opposed relationship to said set of support ribs in said upper-wire loop, the improvement comprising the steps of:

positioning said breast roll in a position in which the fiber consistency of the web is from about 0.7% to about 1.7%, providing said breast roll with an open, non-perforated mantle in which the proportion of opening in said mantle is from about 50% to about 80% of the total area of said mantle whereby water removed from the web through said upper wire is carded in connection with said open, non-perforated mantle, and improving retention of fines/fillers in the web as the web runs through said at least one MB-unit by moving said breast roll to a position in which an area of said breast roll over which said upper wire runs presses into an upper face of the web without curving said lower wire to a substantial extent such that a thin couched layer of the web is formed at said upper face, said couched layer of the web causing fines/fillers to be retained in the web as the web passes over said set of support ribs in said upper-wire loop of said at least one MB-unit.

7. The method of claim 6, wherein said breast roll and said upper wire running thereover are pressed into the upper face of the web to a depth from about 1 mm to about 5 mm.

8. The method of claim 6, further comprising the step of selecting a diameter of said breast roll between about 500 mm and about 1200 mm based on the width of said upper wire.

* * * * *